US007598801B2

(12) United States Patent
Yen et al.

(10) Patent No.: US 7,598,801 B2
(45) Date of Patent: Oct. 6, 2009

(54) VOLTAGE REGULATOR, VOLTAGE REGULATING METHOD THEREOF AND VOLTAGE GENERATOR USING THE SAME

(75) Inventors: Chih-Jen Yen, Hsinchu (TW); Chih-Yuan Hsieh, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 271 days.

(21) Appl. No.: 11/832,657

(22) Filed: Aug. 2, 2007

(65) Prior Publication Data

US 2008/0297125 A1 Dec. 4, 2008

(30) Foreign Application Priority Data

May 29, 2007 (TW) ..... 96119087 A

(51) Int. Cl.
*G05F 1/46* (2006.01)

(52) U.S. Cl. ..... 327/542; 327/541; 330/253; 330/9; 323/316

(58) Field of Classification Search ..... 327/110, 327/141, 355, 427, 434, 538, 540–543; 323/264, 323/267, 271, 272–275, 277, 312–316, 282–286; 330/301, 253, 69, 48, 9, 51, 107; 307/66, 307/77, 110

See application file for complete search history.

(56) References Cited

U.S. PATENT DOCUMENTS

| | | | | |
|---|---|---|---|---|
| 4,543,534 | A * | 9/1985 | Temes et al. | 330/9 |
| 5,146,476 | A * | 9/1992 | Whitehead et al. | 375/345 |
| 5,512,848 | A * | 4/1996 | Yaklin | 327/65 |
| 5,686,821 | A * | 11/1997 | Brokaw | 323/273 |
| 6,034,568 | A * | 3/2000 | Bonaccio et al. | 330/253 |
| 6,228,332 | B1 * | 5/2001 | Dunn et al. | 422/186.3 |
| 6,643,151 | B1 * | 11/2003 | Nebrigic et al. | 363/59 |

* cited by examiner

*Primary Examiner*—Rajnikant B Patel
(74) *Attorney, Agent, or Firm*—Jianq Chyun IP Office

(57) ABSTRACT

A voltage regulator and a voltage regulating method thereof and a voltage generator using the voltage regulator are disclosed by the present invention. The voltage regulator of the present invention uses a first switching unit and a second switching unit to respectively provide an operational transconductance amplifier (OTA) with different closed-loop feedback paths during a first period and a second period. In this way, an auto-zeroing unit is able to exactly store an input offset voltage presented between the inverting input terminal and the non-inverting input terminal of the OTA.

20 Claims, 13 Drawing Sheets

VOLTAGE REGULATOR, VOLTAGE REGULATING METHOD THEREOF AND VOLTAGE GENERATOR USING THE SAME

CROSS-REFERENCE TO RELATED APPLICATION

This application claims the priority benefit of Taiwan application serial no. 96119087, filed May 29, 2007. All disclosure of the Taiwan application is incorporated herein by reference.

BACKGROUND OF THE INVENTION

1. Field of the Invention

The present invention generally relates to a voltage regulator, and more particularly, to a voltage regulator with auto-zeroing technique and unaffected by the load connected to an applied load circuit.

2. Description of Related Art

A voltage regulator is popular electrical device and broadly preferred by many analog circuit designers since it can provide an applied load circuit with a stable output voltage.

FIG. 1 is a schematic circuit drawing of a conventional voltage regulator 100. Referring to FIG. 1, during the operation of the voltage regulator 100, the inverting input terminal (−) of an operational transconductance amplifier (OTA) would receive an input voltage $V_i$. Besides, the connection node between resistors $R_1$ and $R_2$ has a voltage equal to the input voltage $V_i$ according to the concept of virtual short. Thus, an output voltage $V_{OUT}$ would be generated at the connection node between the resistor $R_1$ and a PMOS transistor $P_0$. After that, a capacitor $C_L$ is used to stabilize the output voltage $V_{OUT}$ to feed the stabilized output voltage to a load circuit 101 for use, wherein the above-mentioned output voltage $V_{OUT}$ is just the product voltage of the above-mentioned input voltage $V_i$ and a factor of $(1+R_1/R_2)$. The $R_1$ and $R_2$ herein are respectively the resistances of the resistors $R_1$ and $R_2$, while the factor of $(1+R_1/R_2)$ represents the closed-loop gain of the OTA.

Theoretically, the voltage regulator 100 is supposedly to provide a stable output voltage $V_{OUT}$ to the applied load circuit 101. However, due to an unmatched differential input circuit (not shown) in the OTA, an input offset voltage occurs between the inverting input terminal (−) and the non-inverting input terminal (+) of the OTA, which causes the connection node between the resistors $R_1$ and $R_2$ to have a voltage unequal to the input voltage $V_i$ but equal to the sum of the input voltage $V_i$ and an input offset voltage $V_{OS}$. As a result, the output voltage $V_{OUT}$ provided by the voltage regulator 100 contains a little error provided to the applied load circuit 101, but such an error is not desired by any analog circuit designer.

In order to solve the error problem of the output voltage $V_{OUT}$ provided by the voltage regulator 100 caused from the unmatched differential input circuit in the OTA, a so-called auto-zeroing technique was proposed by the relevant developers in the art.

FIG. 2 is a schematic circuit drawing of a voltage regulator 200, which is evolved from the conventional voltage regulator 100 by employing the auto-zeroing technique. Referring to FIG. 2, the most of the circuit architecture of the voltage regulator 200 is the same as the voltage regulator 100 except the voltage regulator 200 employs an auto-zeroing unit 201, which is able to simultaneously turn on switches SW1 and SW3 and turn off a switch SW2 during a first period; thus, the capacitor $C_S$ of the auto-zeroing unit 201 would store a compensation voltage with the same polarity and the same voltage level as the input offset voltage $V_{OS}$ presented between the inverting input terminal (−) and the non-inverting input terminal (+) of the OTA.

Then, the auto-zeroing unit 201 simultaneously turns off the switches SW1 and SW3 and turn on the switch SW2 during a second period; so that the compensation voltage stored in the capacitor $C_S$ would counterbalance the input offset voltage $V_{OS}$ presented between the inverting input terminal (−) and the non-inverting input terminal (+) of the OTA, the voltage at the connection node between the resistors $R_1$ and $R_2$ would be equal to the input voltage $V_i$ and the voltage regulator 100 is able to provide an accurate output voltage $V_{OUT}$ without error for the load circuit 101 to use.

Although the auto-zeroing unit 201 of FIG. 2 can theoretically solve the error problem of the output voltage $V_{OUT}$ provided by the voltage regulator 100 caused from the unmatched differential input circuit in the OTA, however, the load effect along with the load circuit 101 has not been considered yet. Considering the load effect along with the load circuit 101, the compensation voltage stored by the capacitor $C_S$ of the auto-zeroing unit 201 during the first period would not be exactly the input offset voltage $V_{OS}$ presented between the inverting input terminal (−) and the non-inverting input terminal (+) of the OTA.

The reason for the above-mentioned load effect and the negative impact thereof rests in that when the load current of the load circuit 101 has a transient change, the transient current would be fed back to the non-inverting input terminal (+) through the closed-loop feedback path of the OTA, so that the compensation voltage stored by the capacitor $C_S$ of the auto-zeroing unit 201 during the first period would not be exactly the input offset voltage $V_{OS}$ presented between the inverting input terminal (−) and the non-inverting input terminal (+) of the OTA; furthermore during the second period, the compensation voltage stored by the capacitor $C_S$ of the auto-zeroing unit 201 during the first period is not able to completely counterbalance the input offset voltage $V_{OS}$ presented between the inverting input terminal (−) and the non-inverting input terminal (+) of the OTA, which results in an error of the output voltage $V_{OUT}$ provided by the voltage regulator 100.

SUMMARY OF THE INVENTION

Accordingly, the present invention is directed to a voltage regulator and a voltage regulating method thereof, where a first switching unit and a second switching unit are used to respectively provide an OTA with different closed-loop feedback paths during a first period and a second period so that an auto-zeroing unit is able to exactly store the input offset voltage $V_{OS}$ presented between the inverting input terminal (−) and the non-inverting input terminal (+) of the OTA.

The present invention is also directed to a voltage generator having the above-mentioned voltage regulator and voltage regulating method thereof provided by the present invention.

The present invention provides a voltage regulator, which includes an operational transconductance amplifier (OTA), an auto-zeroing unit, a feedback unit, a first switching unit and a second switching unit. The OTA herein has an inverting input terminal (−), a non-inverting input terminal (+), a first output terminal and a second output terminal, and there is an input offset voltage presented between the inverting input terminal (−) and the non-inverting input terminal (+). The auto-zeroing unit has a first input terminal, a third output terminal and a fourth output terminal, wherein the first input terminal thereof is for receiving an input voltage, the third output terminal thereof is coupled to the inverting input terminal of the OTA and the fourth output terminal thereof is coupled to the non-inverting input terminal of the OTA. The auto-zeroing unit is for detecting the input offset voltage presented between the inverting input terminal and the non-inverting input terminal of the OTA during a first period to thereby generate a compensation voltage with the same polarity and the same voltage level as the input offset voltage and for counterbalancing the input offset voltage presented between the inverting input terminal and the non-inverting input terminal of the OTA by using the compensation voltage during a second period.

The feedback unit has a first feedback terminal and a second feedback terminal, wherein the first feedback terminal is coupled to the non-inverting input terminal of the OTA and the feedback unit is for deciding the closed-loop gain of the OTA. The first switching unit has a second input terminal and a fifth output terminal, wherein the second input terminal is coupled to the first output terminal of the OTA and the first switching unit is for making the fifth output terminal of the first switching unit coupled to the second feedback terminal of the feedback unit. The second switching unit has a third input terminal, a sixth output terminal and a seventh output terminal, wherein the third input terminal is coupled to the second output terminal of the OTA and the second switching unit is for making the sixth output terminal of the second switching unit coupled to the second feedback terminal of the feedback unit during the second period and using the seventh output terminal thereof to output an output voltage to a load circuit for use. The output voltage herein is the product of the above-mentioned input voltage and the closed-loop gain decided by the feedback unit and the load current of the load circuit has transient change behaviour.

In an embodiment of the present invention, the voltage regulator further includes a first energy-storing component having a first terminal and a second terminal, wherein the first terminal of the first energy-storing component is coupled to the seventh output terminal of the second switching unit and the second terminal of the first energy-storing component is coupled to a reference voltage level.

In an embodiment of the present invention, the auto-zeroing unit includes a first switch, a second switch, a third switch and a second energy-storing component. The first terminal of the first switch is served as the first input terminal of the auto-zeroing unit for receiving the above-mentioned input voltage, while the second terminal of the first switch is served as the third output terminal of the auto-zeroing unit and coupled to the inverting input terminal of the OTA. The first terminal of the second switch is coupled to the first terminal of the first switch, the second terminal of the second switch is coupled to the first terminal of the third switch, and the second terminal of the third switch is served as the fourth output terminal of the auto-zeroing unit and coupled to the non-inverting input terminal of the OTA. The first terminal of the second energy-storing component is coupled to the second terminal of the first switch, while the second terminal of the second energy-storing component is coupled to the second terminal of the second switch. The above-mentioned first switch and third switch are turned on during the first period and turned off during the second period, while the above-mentioned second switch is turned off during the first period and turned on during the second period.

In an embodiment of the present invention, the first switching unit includes a first transistor and a fourth switch, wherein the source of the first transistor is coupled to a system voltage and the gate of the first transistor is served as the second input terminal of the first switching unit and coupled to the first output terminal of the OTA; the first terminal of the fourth switch is coupled to the drain of the first transistor and the second terminal of the fourth switch is served as the fifth output terminal of the first switching unit and coupled to the second feedback terminal of the feedback unit. The fourth switch is turned on during the first period and turned off during the second period, and the first transistor is a PMOS transistor.

In an embodiment of the present invention, when the first transistor is a PMOS transistor, the feedback unit includes a first resistor and a second resistor, wherein the first end of the first resistor is served as the first feedback terminal of the feedback unit and coupled to the non-inverting input terminal of the OTA; the second end of the first resistor is served as the second feedback terminal of the feedback unit and coupled to the second terminal of the fourth switch; the first end of the second resistor is coupled to the first end of the first resistor and the second end of the second resistor is coupled to the above-mentioned reference voltage level.

In an embodiment of the present invention, the first switching unit includes a fourth switch and a first transistor, wherein the first terminal of the fourth switch is served as the fifth output terminal of the first switching unit and coupled to the second feedback terminal of the feedback unit; the drain of the first transistor is coupled to the second terminal of the fourth switch, the gate of the first transistor is served as the second input terminal of the first switching unit and coupled to the first output terminal of the OTA and the source of the first transistor is coupled to the above-mentioned reference voltage level. The fourth switch is turned on during the first period and turned off during the second period, and the first transistor is an NMOS transistor.

In an embodiment of the present invention, when the first transistor is an NMOS transistor, the feedback unit includes a first resistor and a second resistor, wherein the first end of the first resistor is coupled to the system voltage, the second end of the first resistor is served as the first feedback terminal of the feedback unit and coupled to the non-inverting input terminal of the OTA; the first end of the second resistor is coupled to the second end of the first resistor and the second end of the second resistor is served as the second feedback terminal of the feedback unit and coupled to the first terminal of the fourth switch.

In an embodiment of the present invention, the second switching unit includes a second transistor and a fifth switch, wherein the source of the second transistor is coupled to the system voltage and the gate of the second transistor is served as the third input terminal of the second switching unit and coupled to the second output terminal of the OTA; the first terminal of the fifth switch is served as the seventh output terminal of the second switching unit and coupled to the drain of the second transistor and the second terminal of the fifth switch is served as the sixth output terminal and coupled to the second feedback terminal of the feedback unit. The fifth switch is turned off during the first period and turned on during the second period, and the second transistor is a PMOS transistor.

In an embodiment of the present invention, when the second transistor is a PMOS transistor, the feedback unit includes a first resistor and a second resistor, wherein the first end of the first resistor is served as the first feedback terminal of the feedback unit and coupled to the non-inverting input terminal of the OTA; the second end of the first resistor is served as the second feedback terminal of the feedback unit and coupled to the second terminal of the fifth switch; the first end of the second resistor is coupled to the first end of the first resistor and the second end of the second resistor is coupled to the above-mentioned reference voltage level.

In an embodiment of the present invention, the second switching unit includes a fifth switch and a second transistor, wherein the first terminal of the fifth switch is served as the sixth output terminal of the second switching unit and coupled to the second feedback terminal of the feedback unit; the drain of the second transistor is served as the seventh output terminal of the second switching unit and coupled to the second terminal of the fifth switch; the gate of the second transistor is served as the third input terminal of the second switching unit and coupled to the second output terminal of the OTA; the source of the second transistor is coupled to the above-mentioned reference voltage level. The fifth switch is turned off during the first period and turned on during the second period, and the second transistor is an NMOS transistor.

In an embodiment of the present invention, when the second transistor is an NMOS transistor, the feedback unit includes a first resistor and a second resistor, wherein the first end of the first resistor is coupled to the system voltage, the second end of the first resistor is served as the first feedback terminal of the feedback unit and coupled to the non-inverting input terminal of the OTA; the first end of the second resistor is coupled to the second end of the first resistor and the second end of the second resistor is served as the second feedback terminal of the feedback unit and coupled to the first terminal of the fifth switch.

The present invention also provides a voltage regulating method applicable to the above-mentioned voltage regulator of the present invention. The voltage regulating method includes following steps. First during a first period, the second switching unit is used to isolate the above-mentioned output voltage from being fed back to the non-inverting input terminal (+) of the OTA and meanwhile the first switching unit is used to make the OTA and the feedback unit form a complete closed-loop, so that the auto-zeroing unit can exactly detect the input offset voltage presented between the inverting input terminal (−) and the non-inverting input terminal (+) of the OTA to thereby generate the above-mentioned compensation voltage. Next during a second period, the auto-zeroing unit uses the compensation voltage generated by the auto-zeroing unit to counterbalance the input offset voltage presented between the inverting input terminal and the non-inverting input terminal of the OTA. Meanwhile, the fifth output terminal of the first switching unit is isolated from the second feedback terminal of the feedback unit and the second switching unit makes the OTA and the feedback unit form a complete closed-loop, so that the above-mentioned output voltage can be exactly generated at the seventh output terminal of the second switching unit.

The present invention also provides a voltage generator with the voltage regulator of the present invention. The voltage generator includes a Gamma voltage generating device and a common voltage generating device used in a liquid crystal display (LCD) driver. The Gamma voltage generating device herein includes a voltage-dividing module coupled between a first reference voltage and a second reference voltage. The voltage-dividing module is for dividing voltage to generate a plurality of Gamma voltages according to the voltage level difference between the first reference voltage and the second reference voltage, wherein the first reference voltage and the second reference voltage are provided by the voltage regulator of the present invention.

The common voltage generating device includes two voltage regulators of the present invention and two switches. The two voltage regulators are used to respectively provide a first common voltage and a second common voltage, one of the two switches is turned on in a first polarity-reversing duration of an LCD panel in an LCD and meanwhile provides a plurality of pixels in the LCD panel with the first common voltage, and another switch is turned on in a second polarity-reversing duration of the LCD panel and meanwhile provides the above-mentioned plurality of pixels with the second common voltage.

During the first period, since the voltage regulator and the voltage regulating method thereof provided by the present invention use the second switching unit to isolate the output voltage used for the load circuit and provided by the voltage regulator from the closed-loop feedback path of the OTA, and meanwhile use the first switching unit to make the OTA and the feedback unit form a complete closed-loop, so that the auto-zeroing unit is unaffected by any transient change of load current in the load circuit; therefore, the present invention is capable of exactly detecting the input offset voltage presented between the inverting input terminal and the non-inverting input terminal of the OTA. After that during the second period, the compensation voltage generated by the auto-zeroing unit during the first period is used to counterbalance the input offset voltage presented between the inverting input terminal and the non-inverting input terminal of the OTA, and meanwhile the first switching unit is isolated from the feedback unit and the second switching unit is used to make the OTA and the feedback unit form a complete closed-loop, so that the voltage regulator is able to exactly generate an output voltage for the load circuit to use.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
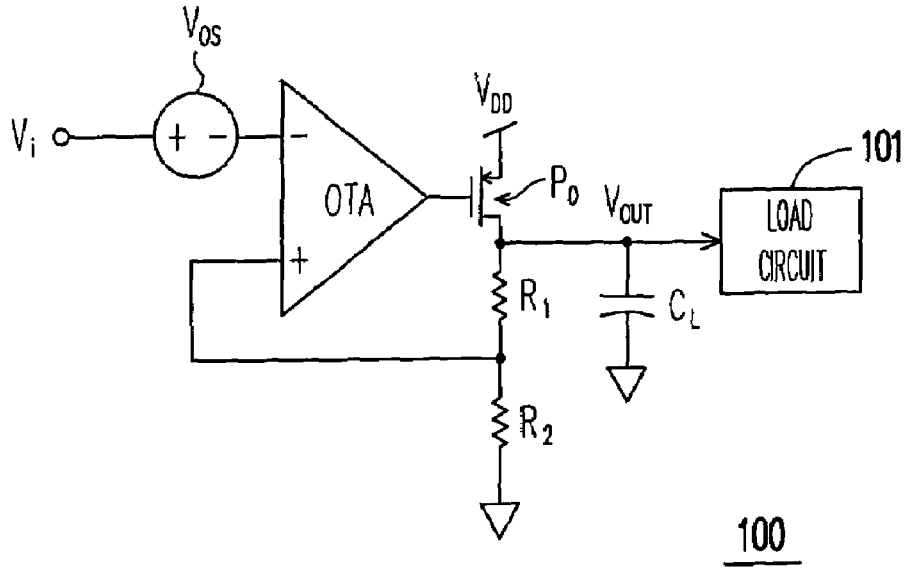
FIG. 1 (PRIOR ART)
FIG. 1 is a schematic circuit drawing of a conventional voltage regulator 100.
Figure 2:
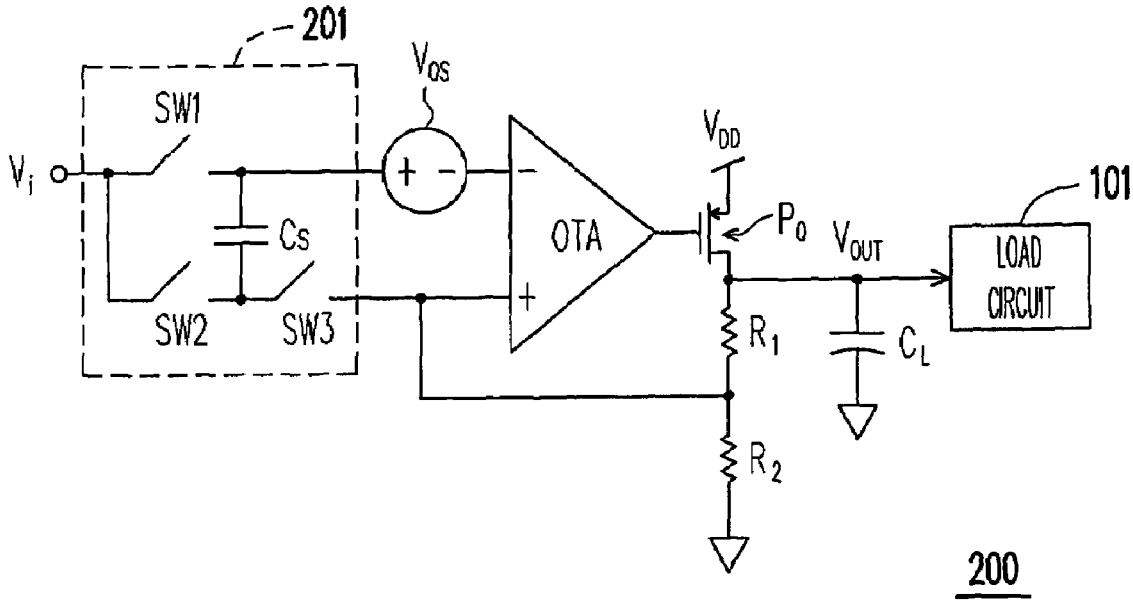
FIG. 2 (PRIOR ART)
FIG. 2 is a schematic circuit drawing of a voltage regulator 200, which is evolved from the conventional voltage regulator 100 by employing the auto-zeroing technique.

Reference will now be made in detail to the present preferred embodiments of the invention, examples of which are illustrated in the accompanying drawings. Wherever possible, the same reference numbers are used in the drawings and the description to refer to the same or like parts.

The technical goal to achieve of the present invention is to provide a voltage regulator unaffected by any transient change of the load current in an applied load circuit and capable of exactly providing the output voltage of the voltage regulator to the applied load circuit for use. In the following, the technical features of the present invention and the technical goal to be achieved are depicted in detail for anyone skilled in the art for reference.

Figure 3:
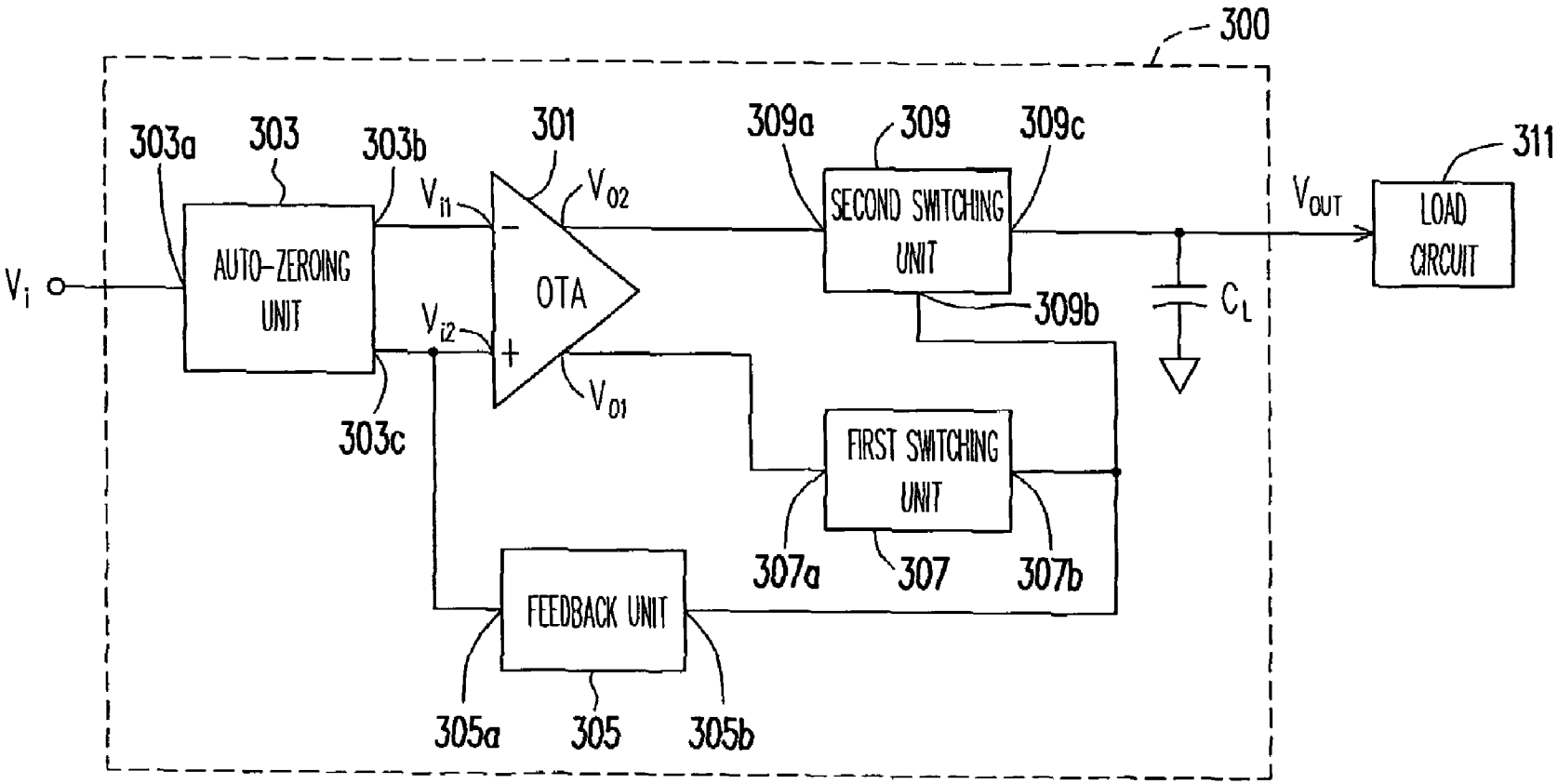
FIG. 3 is a block diagram of a voltage regulator 300 provided by an embodiment of the present invention.
Figure 4:
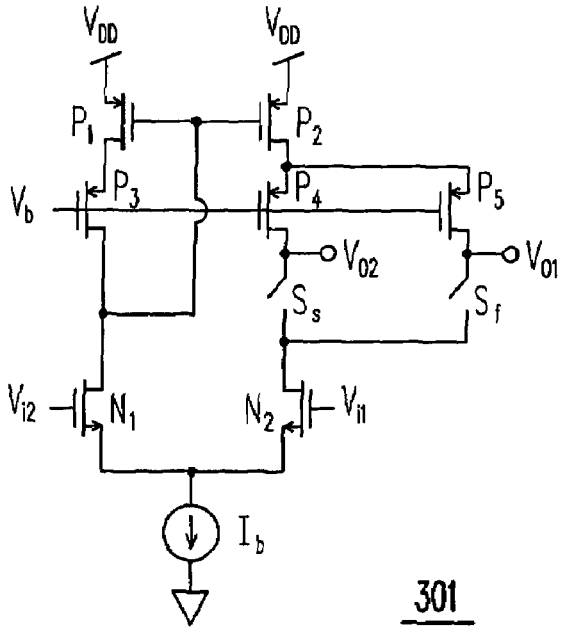
FIGS. 4-17 are schematic circuit drawings of operational transconductance amplifiers (OTAs) 301 adopted by the voltage regulator 300 of the present embodiment.
Figure 5:
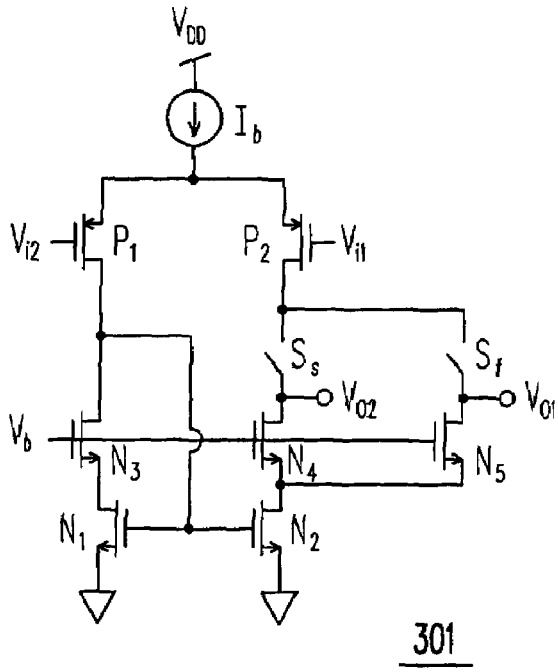
Figure 6:
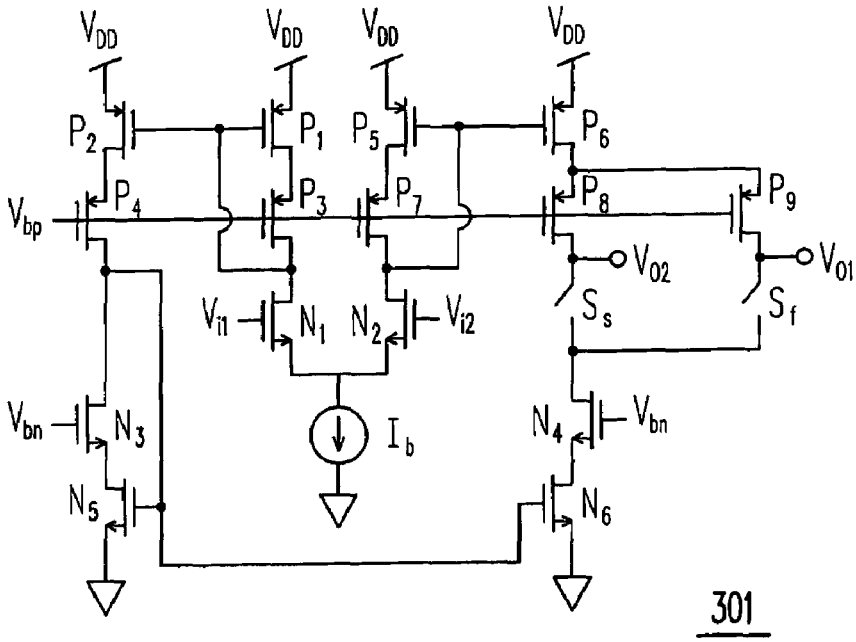
Figure 7:
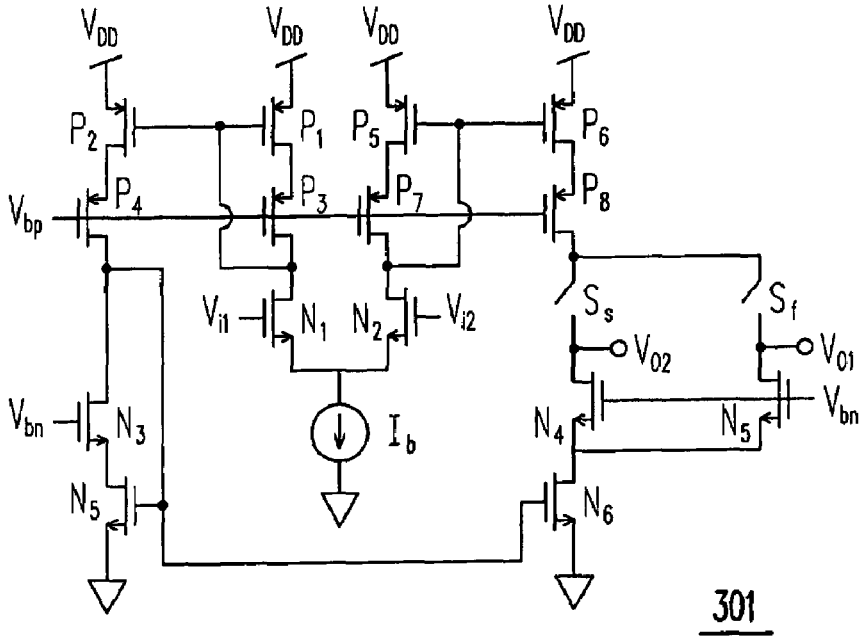
Figure 8:
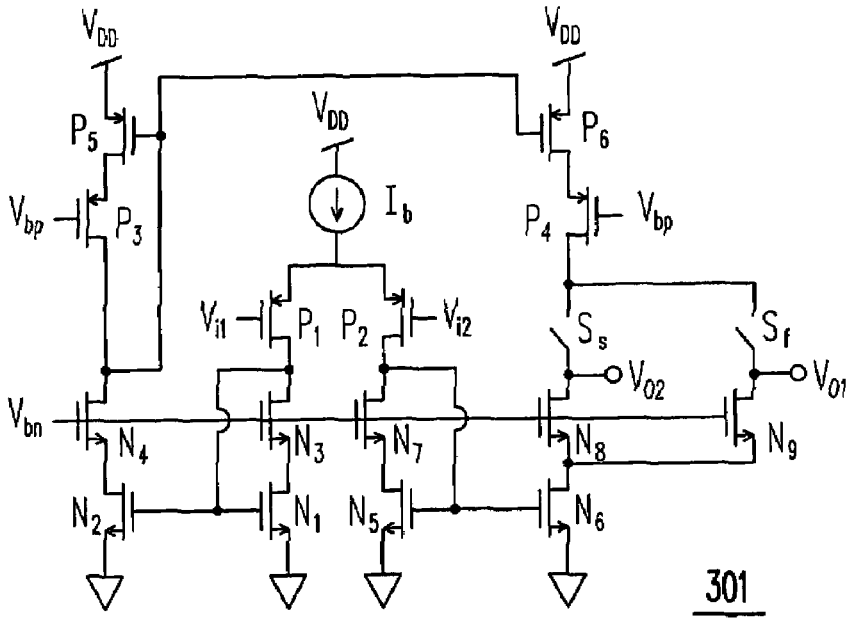
Figure 9:
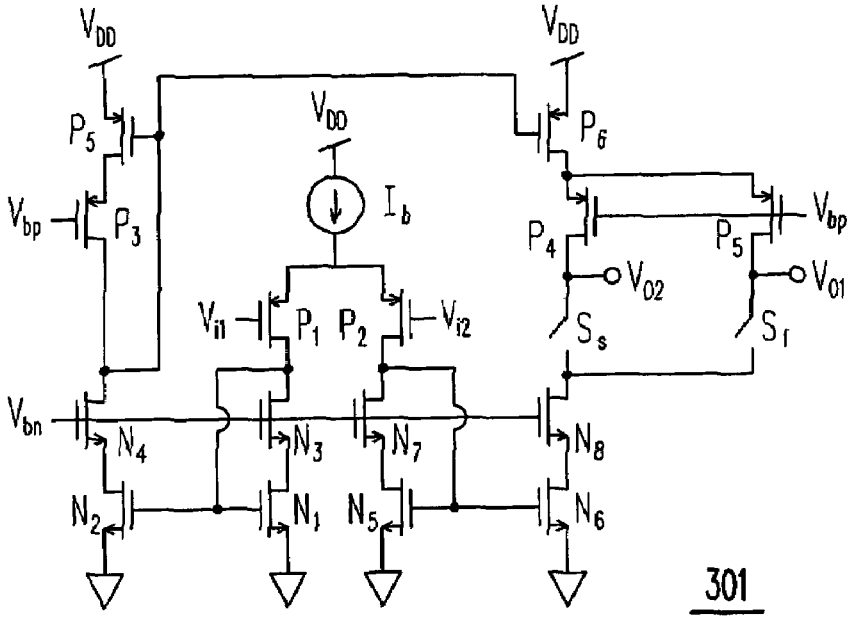
Figure 10:
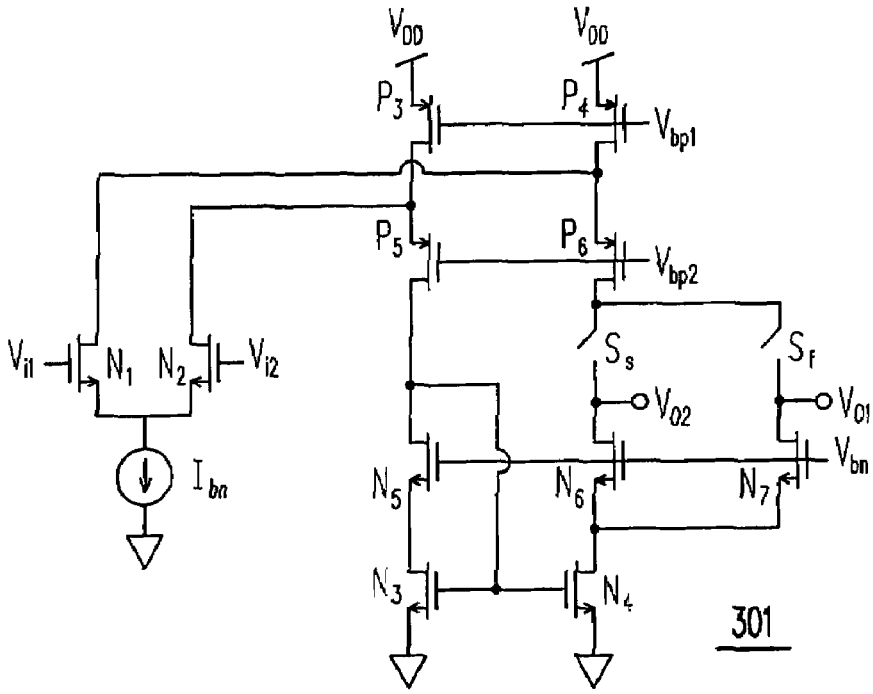
Figure 11:
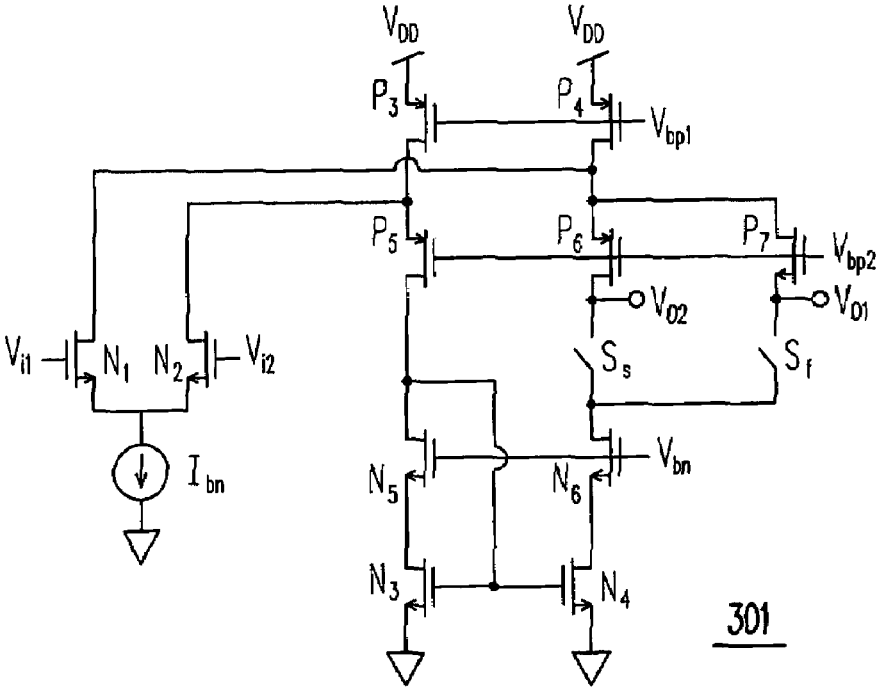
Figure 12:
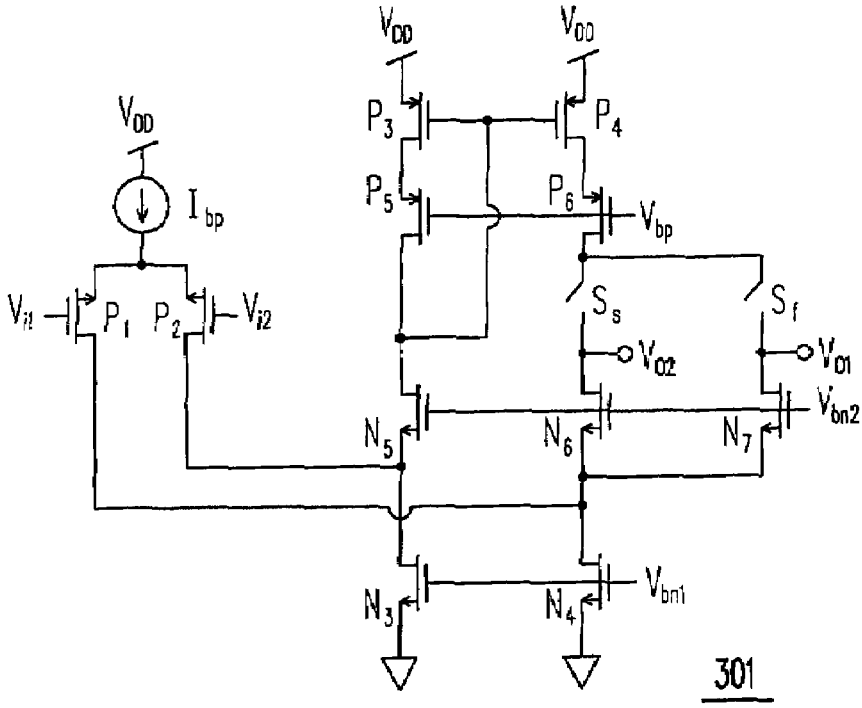
Figure 13:
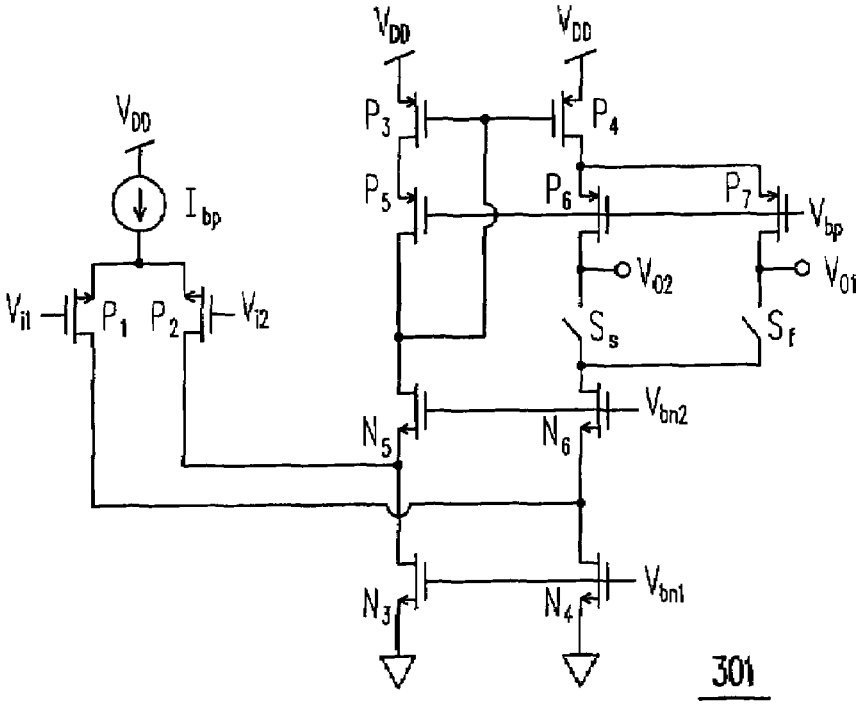
Figure 14:
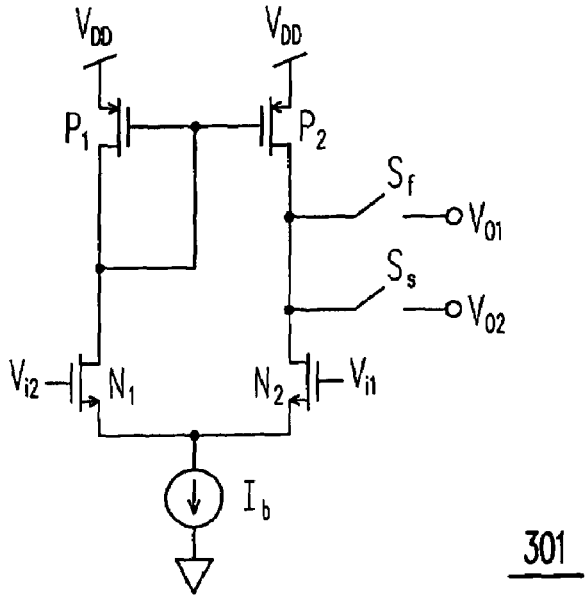
Figure 15:
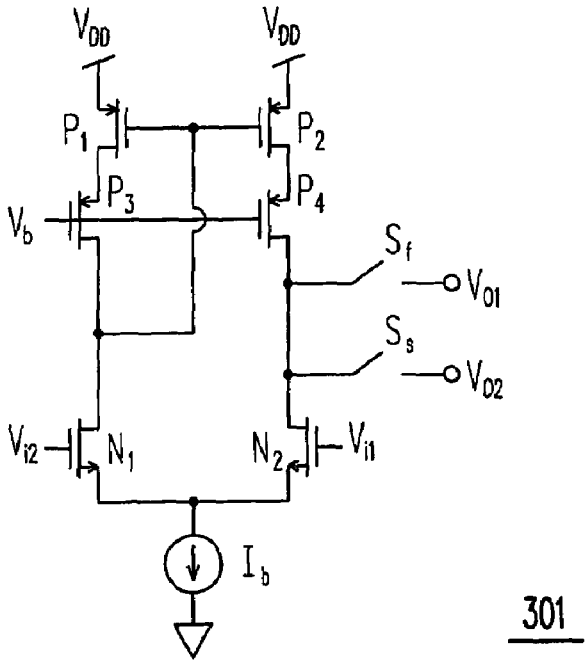
Figure 16:
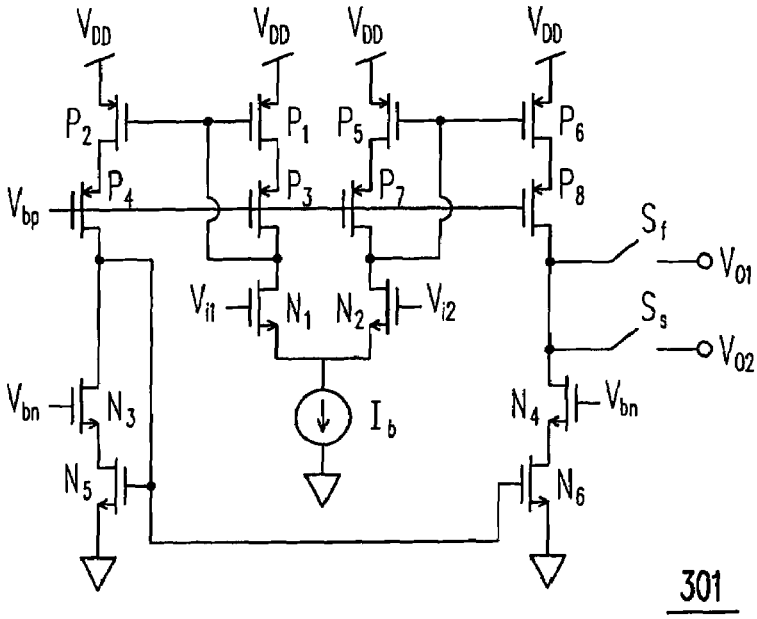
Figure 17:
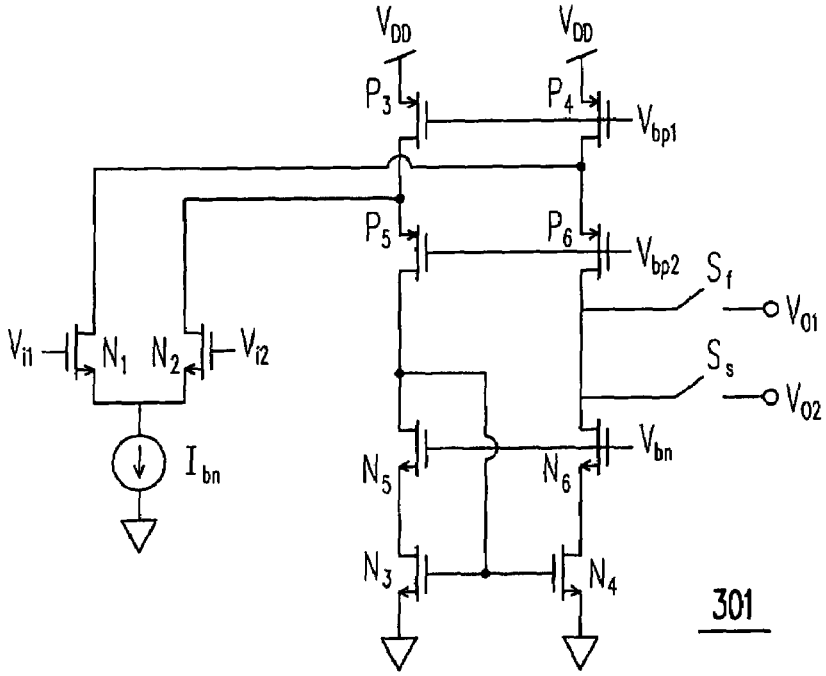

FIG. 3 is a block diagram of a voltage regulator 300 provided by an embodiment of the present invention. Referring to FIG. 3, a voltage regulator 300 includes an OTA 301, an auto-zeroing unit 303, a feedback unit 305, a first switching unit 307, a second switching unit 309 and a first energy-storing component $C_L$. In the present embodiment, the OTA 301 has an inverting input terminal (−) $V_{i1}$, a non-inverting input terminal (+) $V_{i2}$, a first output terminal $V_{O1}$ and a second output terminal $V_{O2}$, wherein an input offset voltage $V_{OS}$ is presented between the inverting input terminal $V_{i1}$ and the non-inverting input terminal $V_{i2}$. It is assumed that anyone skilled in the art should be familiar with the cause to present the input offset voltage $V_{OS}$, thus it is omitted to describe for simplicity. FIGS. 4-17 are schematic circuit drawings of operational transconductance amplifiers (OTAs) 301 adopted by the present embodiment, which are reserved for depiction hereinafter.

The auto-zeroing unit 303 has a first input terminal 303*a*, a third output terminal 303*b* and a fourth output terminal 303*c*, wherein the first input terminal 303*a* is for receiving an input voltage $V_i$, the third output terminal 303*b* is coupled to the inverting input terminal $V_{i1}$ of the OTA 301, and the fourth output terminal 303*c* is coupled to the non-inverting input terminal $V_{i2}$ of the OTA 301. The auto-zeroing unit 303 is for detecting the input offset voltage $V_{OS}$ presented between the inverting input terminal $V_{i1}$ and the non-inverting input terminal $V_{i2}$ of the OTA 301 during a first period and thereby generate a compensation voltage with the same polarity and the same voltage level as the input offset voltage, and for using the compensation voltage to counterbalance the input offset voltage presented between the inverting input terminal $V_{i1}$ and the non-inverting input terminal $V_{i2}$ of the OTA 301 during a second period.

The feedback unit 305 has a first feedback terminal 305*a* and a second feedback terminal 305*b*, wherein the first feedback terminal 305*a* is coupled to the non-inverting input terminal $V_{i2}$ of the OTA 301 and the feedback unit 305 is for deciding the closed-loop gain of the OTA 301. The first switching unit 307 has a second input terminal 307*a* and a fifth output terminal 307*b*, wherein the second input terminal 307*a* is coupled to the first output terminal $V_{O1}$ of the OTA 301 and the first switching unit 307 is for making the fifth output terminal 307*b* of the first switching unit 307 coupled to the second feedback terminal 305*b* of the feedback unit 305 during the first period.

The second switching unit 309 has a third input terminal 309*a*, a sixth output terminal 309*b* and a seventh output terminal 309*c*, wherein the third input terminal 309*a* is coupled to the second output terminal $V_{O2}$ of the OTA 301, the second switching unit 309 is for making the sixth output terminal 309*b* of the second switching unit 309 coupled to the second feedback terminal 305*b* of the feedback unit 305 during the second period and the seventh output terminal 309*c* is used to output an output voltage $V_{OUT}$ to a load circuit 311 for use. The output voltage $V_{OUT}$ herein is the product of the input voltage $V_i$ and the closed-loop gain of the feedback unit 305 and the load current of the load circuit 311 has transient behaviour. The first energy-storing component $C_L$ can be implemented by a capacitor and the first energy-storing component $C_L$ is for enabling the output voltage $V_{OUT}$ more stable, followed by sending the output voltage $V_{OUT}$ to the load circuit 311 for use.

Figure 18:
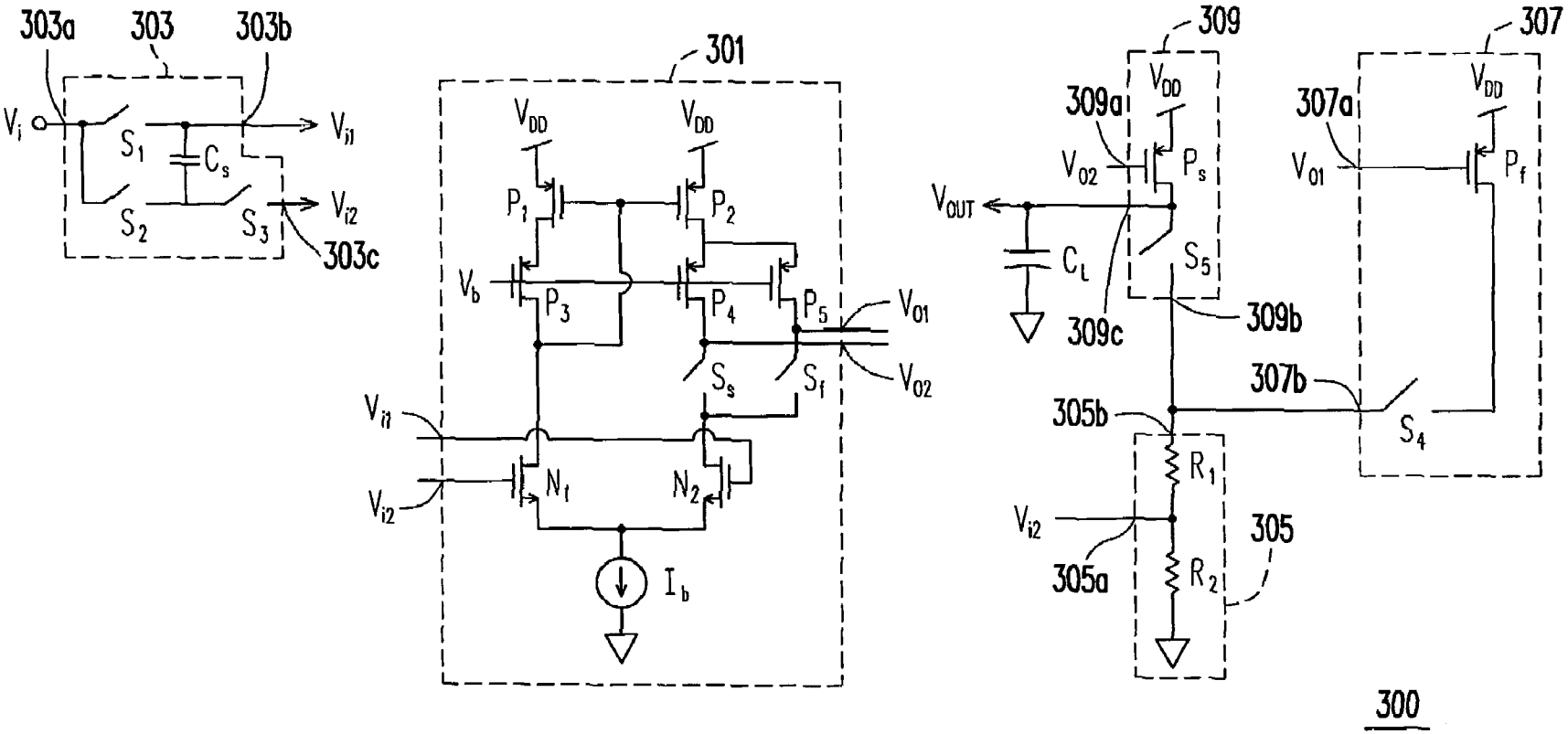
FIG. 18 is a schematic circuit drawing of the voltage regulator 300 of the embodiment.

FIG. 18 is a schematic circuit drawing of the voltage regulator 300 of the embodiment. Referring to FIGS. 1-18, the OTA 301 in the voltage regulator 300 herein is exemplarily the same as the OTA 301 in FIG. 4. The circuit architecture in the OTA 301 of the embodiment should be familiar with by anyone skilled in the art, thus, it is omitted to describe. However, the switches $S_f$ and $S_S$ in the OTA 301 are respectively turned on during the first period and the second period.

The auto-zeroing unit 303 includes a first switch $S_1$, a second switch $S_2$, a third switch $S_3$ and a second energy-storing component $C_S$, wherein the first terminal of the first switch $S_1$ is served as the first input terminal 303*a* of the auto-zeroing unit 303 for receiving the input voltage $V_i$, the second terminal of the first switch $S_1$ is served as the third output terminal 303*b* of the auto-zeroing unit 303 and coupled to the inverting input terminal $V_{i1}$ of the OTA 301; the first terminal of the second switch $S_2$ is coupled to the first terminal of the first switch $S_1$, the second terminal of the second switch $S_2$ is coupled to the first terminal of the third switch $S_3$; the second terminal of the third switch $S_3$ is served as the fourth output terminal 303*c* of the auto-zeroing unit 303 and coupled to the non-inverting input terminal $V_{i2}$ of the OTA 301; the first terminal of the second energy-storing component $C_S$ is coupled to the second terminal of the first switch $S_1$, the second terminal of the second energy-storing component $C_S$ is coupled to the second terminal of the second switch $S_2$. The first switch $S_1$ and the third switch $S_3$ herein are turned on during the first period and off during the second period; the above-mentioned second switch $S_2$ is turned off during the first period and on during the second period. Besides, the second energy-storing component $C_S$ can be implemented by a capacitor.

The feedback unit 305 includes a first resistor $R_1$ and a second resistor $R_2$, wherein the first end of the first resistor $R_1$ is served as the first feedback terminal 305*a* of the feedback unit 305 and coupled to the non-inverting input terminal $V_{i2}$ of the OTA 301, and the second end of the first resistor $R_1$ is served as the second feedback terminal 305*b* of the feedback unit 305 and coupled to the fifth output terminal 307*b* of the first switching unit 307 and the sixth output terminal 309*b* of the second switching unit 309; the first end of the second resistor $R_2$ is coupled to the first end of the first resistor $R_1$, and the second end of the second resistor $R_2$ is coupled to a reference voltage level (for example, a grounding level).

The first switching unit 307 includes a first transistor $P_f$ and a fourth switch $S_4$, wherein the source of the first transistor $P_f$ is coupled to a system voltage $V_{DD}$, the gate of the first transistor $P_f$ is served as the second input terminal 307*a* of the first switching unit 307 and coupled to the first output terminal $V_{O1}$ of the OTA 301; the first terminal of the fourth switch $S_4$ is coupled to the drain of the first transistor $P_f$, the second terminal of the fourth switch $S_4$ is served as the fifth output terminal 307*b* of the first switching unit 307. The fourth switch $S_4$ is turned on during the first period and off during the second period, and the first transistor $P_f$ is a PMOS transistor.

The second switching unit 309 includes a second transistor $P_S$ and a fifth switch $S_5$, wherein the source of the second transistor $P_S$ is coupled to the system voltage $V_{DD}$, the gate of the second transistor $P_S$ is served as the third input terminal 309*a* of the second switching unit 309 and coupled to the second output terminal $V_{O2}$ of the OTA 301; the first terminal of the fifth switch $S_5$ is served as the seventh output terminal

309*c* of the second switching unit 309 and coupled to the drain of the second transistor $P_S$, the second terminal of the fifth switch $S_5$ is served as the sixth output terminal 309*b*. The fifth switch $S_5$ is turned off during the first period and on during the second period, and the second transistor $P_S$ is a PMOS transistor.

Figure 19:
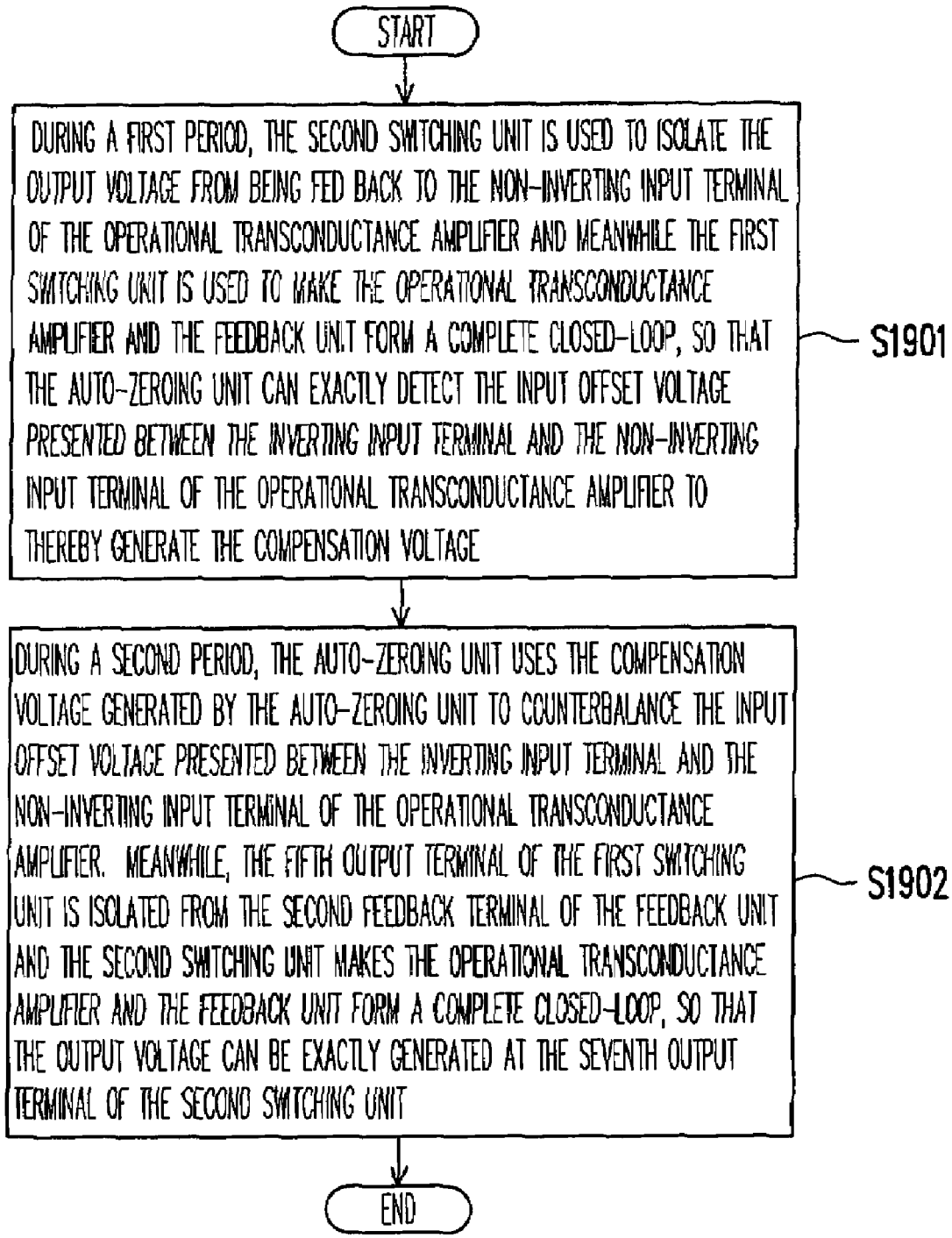
FIG. 19 is a flowchart diagram of the voltage regulating method used by the voltage regulator 300 of the embodiment.

In order to more clearly explain the operation principle of the voltage regulator 300 of the present embodiment, a voltage regulating method is described in the following for anyone skilled in the art for reference. FIG. 19 is a flowchart diagram of the voltage regulating method used by the voltage regulator 300 of the embodiment. Referring FIGS. 3, 18 and 19, the voltage regulating method of the voltage regulator 300 of the embodiment includes following steps. First in step S1901, during the first period, the second switching unit 309 is used to isolate the above-mentioned output voltage $V_{OUT}$ from being fed back to the non-inverting input terminal $V_{i2}$ of the OTA 301 and meanwhile the first switching unit 307 is used to make the OTA 301 and the feedback unit 305 form a complete closed-loop, so that the auto-zeroing unit 303 can exactly detect the input offset voltage $V_{OS}$ presented between the inverting input terminal $V_{i1}$ and the non-inverting input terminal $V_{i2}$ of the OTA 301 to thereby generate the above-mentioned compensation voltage.

In order to achieve the expected result described by step S1901, during the first period, the switch $S_f$ in the OTA 301, the first switch $S_1$ and the third switch $S_3$ in the auto-zeroing unit 303 and the fourth switch $S_4$ in the first switching unit 307 must be turned on, while the switch $S_S$ in the OTA 301, the second switch $S_2$ in the auto-zeroing unit 303 and the fifth switch $S_5$ in the second switching unit 309 must be turned off. Therefore, when a transient change of the load current of the load circuit 311 occurs, the transient voltage would not be fed back to the non-inverting input terminal $V_{i2}$ of the OTA 301 via the closed-loop path of the OTA 301. In this way, the second energy-storing component $C_S$ of the auto-zeroing unit 303 is able to store a compensation voltage with the same polarity and the same voltage level as the input offset voltage $V_{OS}$ presented between the inverting input terminal $V_{i1}$ and the non-inverting input terminal $V_{i2}$ of the OTA 301.

Next in step S1902, during the second period, the auto-zeroing unit 303 uses the compensation voltage generated by the auto-zeroing unit during the first period to counterbalance the input offset voltage presented between the inverting input terminal $V_{i1}$ and the non-inverting input terminal $V_{i2}$ of the OTA 301. Meanwhile, the fifth output terminal 307*b* of the first switching unit 307 is isolated from the second feedback terminal 305*b* of the feedback unit 305 and the second switching unit 309 makes the OTA 301 and the feedback unit 305 form a complete closed-loop, so that the above-mentioned output voltage $V_{OUT}$ can be exactly generated at the seventh output terminal 309*c* of the second switching unit 309.

In order to achieve the expected result described by step S1902, during the second period, the switch $S_f$ in the OTA 301, the first switch $S_1$ and the third switch $S_3$ in the auto-zeroing unit 303 and the fourth switch $S_4$ in the first switching unit 307 must be turned off, while the switch $S_S$ in the OTA 301, the second switch $S_2$ in the auto-zeroing unit 303 and the fifth switch $S_5$ in the second switching unit 309 must be turned on.

At the time, since the compensation voltage stored by the second energy-storing component $C_S$ of the auto-zeroing unit 303 during the first period has the same polarity and the same voltage level as the input offset voltage presented between the inverting input terminal $V_{i1}$ and the non-inverting input terminal $V_{i2}$ of the OTA 301, even though the load current of the load circuit 311 has transient change and the voltage variation is fed back to the non-inverting input terminal $V_{i2}$ of the OTA 301 via the closed-loop path of the OTA 301, the compensation voltage stored by the second energy-storing component $C_S$ of the auto-zeroing unit 303 during the first period is still able to completely counterbalance the input offset voltage presented between the inverting input terminal $V_{i1}$ and the non-inverting input terminal $V_{i2}$ of the OTA 301. Thus, the output voltage $V_{OUT}$ generated at the seventh output terminal 309*c* of the second switching unit 309 is just the product of the above-mentioned input voltage $V_i$ and a factor of $(1+R_1/R_2)$, where $R_1$ and $R_2$ are respectively the resistances of the resistors $R_1$ and $R_2$, and the factor of $(1+R_1/R_2)$ is the closed-loop gain of the OTA 301.

In this way, the voltage regulator 300 is unaffected by the transient change of the load current of the applied load circuit 311 and is able to exactly provide the applied load circuit 311 with the accurate output voltage $V_{OUT}$ thereof. Note that the OTA 301 of the voltage regulator 300 shown by FIG. 18 is exemplarily the OTA 301 shown by FIG. 4, but the present embodiment does not limit thereto. In other words, the OTA 301 of the voltage regulator 300 can be implemented by any OTA 301 shown by FIGS. 5-17, as long as the switch $S_f$ thereof is turned on during the first period and the switch $S_S$ is turned on during the second period.

In addition, the fourth switch $S_4$ and the fifth switch $S_5$ in the first switching unit 307 and the second switching unit 309 are implemented by PMOS transistors, but the present invention does not limit thereto. In other words, a user can use NMOS transistors to implement the fourth switch $S_4$ and the fifth switch $S_5$ in the first switching unit 307 and the second switching unit 309 according to a practical design need. In the following, a voltage regulator 300 is described wherein the fourth switch $S_4$ and the fifth switch $S_5$ in the first switching unit 307 and the second switching unit 309 of the voltage regulator 300 are implemented by NMOS transistors.

Figure 20:
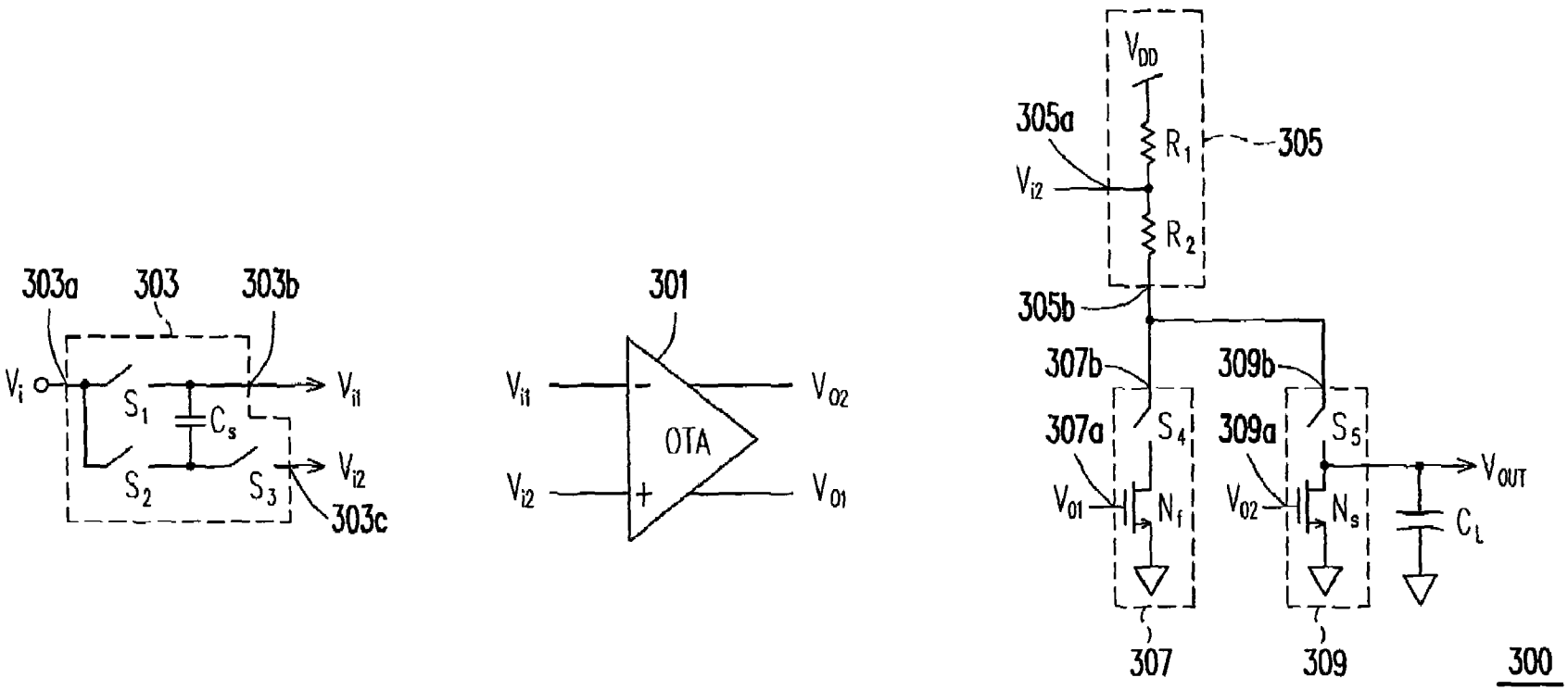
FIG. 20 is a schematic circuit drawing of a voltage regulator 300 provided by another embodiment of the present invention.

FIG. 20 is a schematic circuit drawing of a voltage regulator 300 provided by another embodiment of the present invention. Referring to FIGS. 18 and 20, the fourth switch $S_4$ and the fifth switch $S_5$ in the first switching unit 307 and the second switching unit 309 are implemented by NMOS transistors, wherein the first switching unit 307 includes a fourth switch $S_4$ and a first transistor $N_f$, the first terminal of the fourth switch $S_4$ is served as the fifth output terminal 307*b* of the first switching unit 307 and coupled to the second feedback terminal 305*b* of the feedback unit 305. The drain of the first transistor $N_f$ is coupled to the second terminal of the fourth switch $S_4$, the gate of first transistor $N_f$ is served as the second input terminal 307*a* of the first switching unit 307 and coupled to the first output terminal $V_{O1}$ of the OTA 301, and the source of the first transistor $N_f$ is coupled to the above-mentioned reference voltage level. The fourth switch $S_4$ herein is turned on during the first period and off during the second period.

The second switching unit 309 includes a fifth switch $S_5$ and a second transistor $N_S$, wherein the first terminal of the fifth switch $S_5$ is served as the sixth output terminal 309*b* of the second switching unit 309 and coupled to second feedback terminal 305*b* of the feedback unit 305; the drain of the second transistor $N_S$ is served as the seventh output terminal 309*c* of the second switching unit 309 and coupled to the second terminal of the fifth switch $S_5$, the gate of the second transistor $N_S$ is served as the third input terminal 309*a* of the second switching unit 309 and coupled to the second output terminal $V_{O2}$ of the OTA 301, and the source of the second transistor $N_S$ is coupled to the above-mentioned reference voltage level. The fifth switch $S_5$ herein is turned off during the first period and on during the second period.

Thus, when both of the first transistor $N_f$ and the second transistor $N_S$ are NMOS transistors, the feedback unit 305 includes a first resistor $R_1$ and a second resistor $R_2$, wherein the first end of the first resistor $R_1$ is coupled to the system voltage $V_{DD}$, and the second end of the first resistor $R_1$ is served as the first feedback terminal 305*a* of the feedback unit 305 and coupled to the non-inverting input terminal $V_{i2}$ of the OTA 301; the first end of the second resistor $R_2$ is coupled to the second end of the first resistor $R_1$, and the second end of the second resistor $R_2$ is served as the second feedback terminal 305*b* of the feedback unit 305.

Although the voltage regulator 300 shown by FIG. 20 employs NMOS transistors to implement the fourth switch $S_4$ and the fifth switch $S_5$ in the first switching unit 307 and the second switching unit 309, but the overall operation thereof is the same as the voltage regulator 300 shown by FIG. 18 and, thus, is omitted to describe for simplicity.

It can be seen from the above-described embodiments, the voltage regulator 300 is unaffected by the transient change of the load current of the applied load circuit 311 and is able to exactly provide the applied load circuit 311 with the output voltage $V_{OUT}$ thereof, which make the voltage regulator 300 of the embodiment applicable to applications extremely requiring a stable output voltage to be received. In the following, two application embodiments are depicted for anyone skilled in the art for reference.

Figure 21:
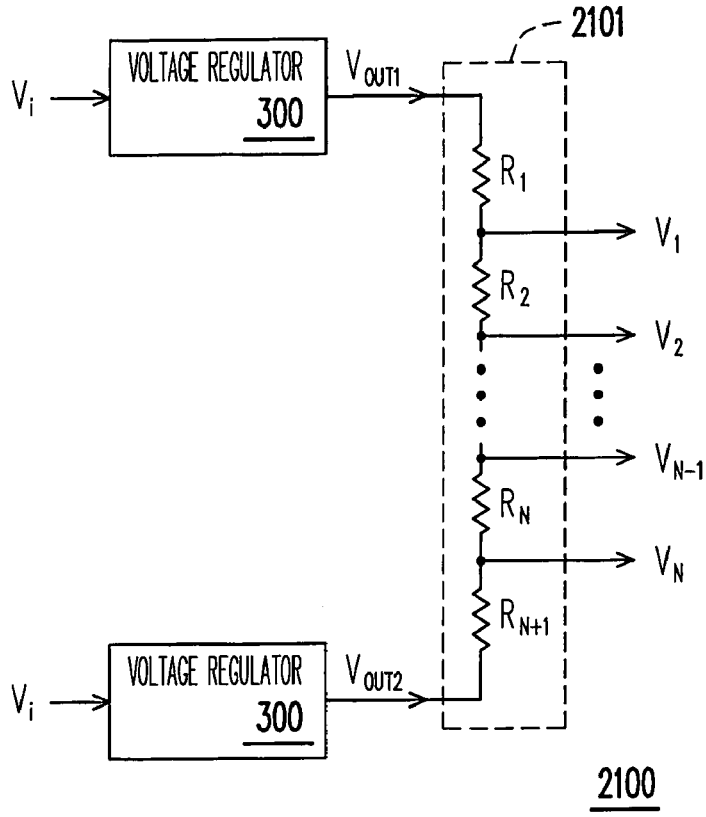
FIG. 21 is an application diagram wherein a Gamma voltage generating device 2100 employs the voltage regulators 300 of the present invention.

Based on the spirit of the present invention, two voltage generating devices with the voltage regulator 300 are provided by an embodiment of the present invention. The voltage generating devices include, for example, a Gamma voltage generating device and a common voltage generating device applicable to an LCD driver. FIG. 21 is an application diagram, wherein a Gamma voltage generating device 2100 employs the voltage regulators 300 of the present invention. Referring to FIGS. 18, 20 and 21, a Gamma voltage generating device 2100 includes a voltage-dividing module 2101 coupled between a first reference voltage $V_{OUT1}$ and a second reference voltage $V_{OUT2}$. The voltage-dividing module 2101 is for conducting a voltage-dividing on the voltage level difference between the first reference voltage $V_{OUT1}$ and the second reference voltage $V_{OUT2}$ to generate a plurality of Gamma voltages $V_1$-$V_N$, wherein the voltage-dividing module 2101 has a plurality of resistors $R_1$-$R_{N+1}$ which are in series connection to each other and coupled between the first reference voltage $V_{OUT1}$ and the second reference voltage $V_{OUT2}$, while the first reference voltage $V_{OUT1}$ and the second reference voltage $V_{OUT2}$ are respectively provided by two voltage regulators 300.

Figure 22:
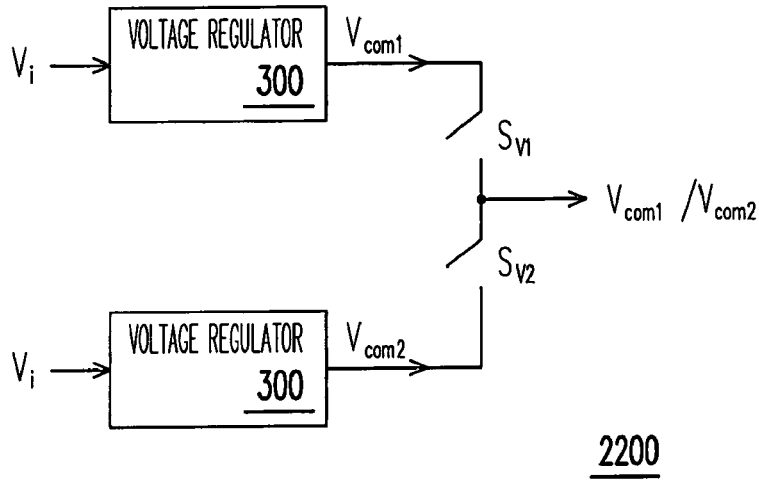
FIG. 22 is an application diagram wherein a common voltage generating device 2200 employs the voltage regulators 300 of the present invention.

FIG. 22 is an application diagram wherein a common voltage generating device 2200 employs the voltage regulators 300 of the present invention. Referring to FIGS. 18, 20 and 22, a common voltage generating device 2200 includes two voltage regulators 300 and switches $S_{V1}$ and $S_{V2}$, wherein the two voltage regulators 300 are for respectively a first common voltage Vcom1 and a second common voltage Vcom2; the switch $S_{V1}$ is turned on in the first polarity-reversing duration of the LCD panel (not shown) and meanwhile provides the first common voltage Vcom1 to the plurality of pixels (not shown) in the LCD panel; the switch $S_{V2}$ is turned on in the second polarity-reversing duration of the LCD panel and meanwhile provides the second common voltage Vcom2 to the plurality of pixels in the LCD panel.

The above-mentioned two voltage generating devices do not mean the voltage regulator 300 of the present invention has the two applications only. In fact, the voltage regulator 300 provided by the present invention is applicable to any application device which requires an extreme accurate output voltage to be received.

In summary, the present invention provides a voltage regulator and the voltage regulating method thereof. According to the depiction of the above-mentioned embodiments, the disclosed voltage regulator is superior in that the voltage regulator is not only unaffected by the transient change of the load current of the applied load circuit, but also is able to exactly provide the applied load circuit with the output voltage thereof. In addition, the provided voltage regulator can find broad applications where an application device requires receiving an extremely accurate output voltage.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage regulator, comprising:

an operational transconductance amplifier, having an inverting input terminal, a non-inverting input terminal, a first output terminal and a second output terminal, wherein there is an input offset voltage presented between the inverting input terminal and the non-inverting input terminal;

an auto-zeroing unit, having a first input terminal, a third output terminal and a fourth output terminal, wherein the first input terminal is for receiving an input voltage, the third output terminal is coupled to the inverting input terminal, the fourth output terminal is coupled to the non-inverting input terminal, the auto-zeroing unit is for detecting the input offset voltage during a first period to thereby generate compensation voltage with the same polarity and the same voltage level as the input offset voltage and for using the compensation voltage to counterbalance the input offset voltage during a second period;

a feedback unit, having a first feedback terminal and a second feedback terminal, wherein the first feedback terminal is coupled to the non-inverting input terminal and the feedback unit is for deciding a closed-loop gain of the operational transconductance amplifier;

a first switching unit, having a second input terminal and a fifth output terminal, wherein the second input terminal is coupled to the first output terminal and the first switching unit is for making the fifth output terminal coupled to the second feedback terminal during the first period; and a second switching unit, having a third input terminal, a sixth output terminal and a seventh output terminal, wherein the third input terminal is coupled to the second output terminal, the second switching unit is for making the sixth output terminal coupled to the second feedback terminal during the second period and using the seventh output terminal to output an output voltage to a load circuit for use, the output voltage is the product of the input voltage and the closed-loop gain, and a load current of the load circuit has transient behaviour.

2. The voltage regulator according to claim 1, further comprising a first energy-storing component, having a first terminal and a second terminal, wherein the first terminal of the first energy-storing component is coupled to the seventh output terminal, while the second terminal of the first energy-storing component is coupled to a reference voltage level.

3. The voltage regulator according to claim 1, wherein the auto-zeroing unit comprises:

a first switch, having a first terminal and a second terminal, wherein the first terminal of the first switch is served as the first input terminal to receive the input voltage, while the second terminal of the first switch is served as the third output terminal and coupled to the inverting input terminal;

a second switch, having a first terminal and a second terminal, wherein the first terminal of the second switch is coupled to the first terminal of the first switch;

a third switch, having a first terminal and a second terminal, wherein the first terminal of the third switch is coupled to the second terminal of the second switch, while the second terminal of the third switch is served as the fourth output terminal and coupled to the non-inverting input terminal; and a second energy-storing component, having a first terminal and a second terminal, wherein the first terminal of the second energy-storing component is coupled to the second terminal of the first switch, while the second terminal of the second energy-storing component is coupled to the second terminal of the second switch, wherein the first switch and the third switch are turned on during the first period and turned off during the second period, while the second switch is turned off during the first period and turned on during the second period.

4. The voltage regulator according to claim 1, wherein the first switching unit comprises:

a first transistor, having a source, a drain and a gate, wherein the source of the first transistor is coupled to a system voltage, while the gate of the first transistor is served as the second input terminal and coupled to the first output terminal; and a fourth switch, having a first terminal and a second terminal, wherein the first terminal of the fourth switch is coupled to the drain of the first transistor, while the second terminal of the fourth switch is served as the fifth output terminal and coupled to the second feedback terminal, wherein the fourth switch is turned on during the first period and turned off during the second period.

5. The voltage regulator according to claim 4, wherein the first transistor is a PMOS transistor.

6. The voltage regulator according to claim 4, wherein the feedback unit comprises:

a first resistor, having a first end and a second end, wherein the first end of the first resistor is served as the first feedback terminal and coupled to the non-inverting input terminal, while the second end of the first resistor is served as the second feedback terminal and coupled to the second terminal of the fourth switch; and a second resistor, having a first end and a second end, wherein the first end of the second resistor is coupled to the first end of the first resistor, while the second end of the second resistor is coupled to a reference voltage level.

7. The voltage regulator according to claim 1, wherein the first switching unit comprises:

a fourth switch, having a first terminal and a second terminal, wherein the first terminal of the fourth switch is served as the fifth output terminal and coupled to the second feedback terminal; and a first transistor, having a drain, a gate and a source, wherein the drain of the first transistor is coupled to the second terminal of the fourth switch, the gate of the first transistor is served as the second input terminal and coupled to the first output terminal and the source of the first transistor is coupled to a reference voltage level, wherein the fourth switch is turned on during the first period and turned off during the second period.

8. The voltage regulator according to claim 7, wherein the first transistor is an NMOS transistor.

9. The voltage regulator according to claim 7, wherein the feedback unit comprises:

a first resistor, having a first end and a second end, wherein the first end of the first resistor is coupled to a system voltage, while the second end of the first resistor is served as the first feedback terminal and coupled to the non-inverting input terminal; and a second resistor, having a first end and a second end, wherein the first end of the second resistor is coupled to the second end of the first resistor, while the second end of the second resistor is served as the second feedback terminal and coupled to the first terminal of the fourth switch.

10. The voltage regulator according to claim 1, wherein the second switching unit comprises:

a second transistor, having a source, a drain and a gate, wherein the source of the second transistor is coupled to a system voltage, while the gate of the second transistor is served as the third input terminal and coupled to the second output terminal; and a fifth switch, having a first terminal and a second terminal, wherein the first terminal of the fifth switch is served as the seventh output terminal and coupled to the drain of the second transistor, while the second terminal of the fifth switch is served as the sixth output terminal and coupled to the second feedback terminal, wherein the fifth switch is turned off during the first period and turned on during the second period.

11. The voltage regulator according to claim 10, wherein the second transistor is a PMOS transistor.

12. The voltage regulator according to claim 10, wherein the feedback unit comprises:

a first resistor, having a first end and a second end, wherein the first end of the first resistor is served as the first feedback terminal and coupled to the non-inverting input terminal, while the second end of the first resistor is served as the second feedback terminal and coupled to the second terminal of the fifth switch; and a second resistor, having a first end and a second end, wherein the first end of the second resistor is coupled to the first end of the first resistor, while the second end of the second resistor is coupled to a reference voltage level.

13. The voltage regulator according to claim 1, wherein the second switching unit comprises:

a fifth switch, having a first terminal and second terminal, wherein the first terminal of the fifth switch is served as the sixth output terminal and coupled to the second feedback terminal;

a second transistor, having a drain, a gate and a source, wherein the drain of the second transistor is served as the seventh output terminal and coupled to the second terminal of the fifth switch, the gate of the second transistor is served as the third input terminal and coupled to the second output terminal and the source of the second transistor is coupled to a reference voltage level, wherein the fifth switch is turned off during the first period and turned on during the second period.

14. The voltage regulator according to claim 13, wherein the second transistor is an NMOS transistor.

15. The voltage regulator according to claim 13, wherein the feedback unit comprises:

a first resistor, having a first end and a second end, wherein the first end of the first resistor is coupled to a system voltage, while the second end of the first resistor is served as the first feedback terminal and coupled to the non-inverting input terminal; and a second resistor, having a first end and a second end, wherein the first end of the second resistor is coupled to the second end of the first resistor, while the second end of the second resistor is served as the second feedback terminal and coupled to the first terminal of the fifth switch.

16. A voltage regulating method, suitable for the voltage regulator according to claim 1; the method comprising following steps:

during the first period, using the second switching unit to isolate the output voltage from being fed back to the non-inverting input terminal of the operational transconductance amplifier and meanwhile using the first switching unit to make the operational transconductance amplifier and the feedback unit form a complete closed-loop, so that the auto-zeroing unit can exactly detect the input offset voltage to thereby generate the compensation voltage; and during the second period, using the compensation voltage generated by the auto-zeroing unit during the first period to counterbalance the input offset voltage, meanwhile isolating the fifth output terminal of the first switching unit from the second feedback terminal of the feedback unit and using the second switching unit to make the operational transconductance amplifier and the feedback unit form a complete closed-loop, so that the output voltage is exactly generated at the seventh output terminal of the second switching unit.

17. A voltage generator, having the voltage regulator according to claim 1.

18. The voltage generator according to claim 17, comprising a Gamma voltage generating device and a common voltage generating device applied in a driving circuit for liquid crystal display.

19. The voltage generator according to claim 18, wherein the Gamma voltage generating device comprises:

a voltage-dividing module, coupled between a first reference voltage and a second reference voltage for conducting voltage-dividing on a voltage level difference between the first reference voltage and the second reference voltage to generate a plurality of Gamma voltages, wherein the first reference voltage and the second reference voltage are respectively provided by the two voltage regulators according to claim 1.

20. The voltage generator according to claim 18, wherein the common voltage generating device comprises:

two voltage regulators according to claim 1 and two switches, wherein the voltage regulators are for respectively providing a first common voltage and a second common voltage, one of the switches is turned on in a first polarity-reversing duration of the liquid crystal display panel and meanwhile provides the first common voltage to a plurality of pixels in the liquid crystal display panel for use, and another switch is turned on in a second polarity-reversing duration of the liquid crystal display panel and meanwhile provides the second common voltage to the pixels for use.

* * * * *